US007955027B2

(12) United States Patent
Nourian et al.

(10) Patent No.: US 7,955,027 B2
(45) Date of Patent: Jun. 7, 2011

(54) SYSTEM AND METHOD FOR A CURVED CONDUIT

(75) Inventors: Daniel Nourian, Reedley, CA (US); Chris Moralez, Lindsay, CA (US); Louis Teran, North Hills, CA (US)

(73) Assignee: National Diversified Sales, Inc., Woodland Hills, CA (US)

( * ) Notice: Subject to any disclaimer, the term of this patent is extended or adjusted under 35 U.S.C. 154(b) by 359 days.

(21) Appl. No.: 12/206,701

(22) Filed: Sep. 8, 2008

(65) Prior Publication Data

US 2010/0061805 A1 Mar. 11, 2010

(51) Int. Cl.
*F16L 27/00* (2006.01)
*E02B 5/08* (2006.01)
*E04D 13/068* (2006.01)

(52) U.S. Cl. ..... 405/122; 405/36; 285/184

(58) Field of Classification Search ..... 405/36, 405/47, 51, 118, 119, 120, 121, 122, 123; 285/184, 185, 325, 326
See application file for complete search history.

(56) References Cited

U.S. PATENT DOCUMENTS

| | | | | | |
|---|---|---|---|---|---|
| 137,562 | A * | 4/1873 | Nichols | 285/290.1 |
| 2,135,103 | A * | 11/1938 | Dimick | 405/47 |
| 2,648,200 | A * | 8/1953 | Dimick | 405/47 |
| 2,893,212 | A * | 7/1959 | Holicky | 405/47 |
| 3,081,599 | A * | 3/1963 | Roberg | 405/47 |
| 3,122,888 | A * | 3/1964 | Boening | 405/47 |
| 3,563,039 | A * | 2/1971 | Olsen | 405/47 |
| 4,033,613 | A * | 7/1977 | Bram | 285/184 |
| 4,436,326 | A * | 3/1984 | Peaster | 285/148.27 |
| 4,954,015 | A * | 9/1990 | McGowan | 405/121 |
| 5,215,338 | A * | 6/1993 | Kimura et al. | 285/154.2 |
| 5,248,004 | A * | 9/1993 | Witte | 175/74 |
| 5,879,106 | A * | 3/1999 | Beamer | 405/36 |
| 5,882,145 | A * | 3/1999 | Beamer | 405/118 |
| 6,592,293 | B1 * | 7/2003 | Hedstrom et al. | 405/48 |
| 7,306,401 | B1 * | 12/2007 | Linkogle | 405/118 |
| 7,413,382 | B2 * | 8/2008 | Hedstrom et al. | 405/46 |
| 2004/0115001 | A1 * | 6/2004 | Suazo et al. | 405/36 |
| 2004/0136785 | A1 * | 7/2004 | Gunter | 405/118 |

* cited by examiner

*Primary Examiner* — Tara Mayo-Pinnock
(74) *Attorney, Agent, or Firm* — Fulwider Patton LLP

(57) ABSTRACT

A system and method are disclosed for converting channels manufactured for connection together to produce a straight conduit into channels that may be connected together to produce an effectively curved conduit. A link is described that permits the connection between two channels to be connected with an axial offset, which cumulatively allows a plurality of channels to produce a curved conduit.

21 Claims, 8 Drawing Sheets

SYSTEM AND METHOD FOR A CURVED CONDUIT

BACKGROUND

The present invention is directed to a connection between two open linear channels for conveying water away from a location where ponding might otherwise occur. Specifically, the invention is directed to a connection that allows a curvature to be introduced into the alignment of the channels, so that the channels may be positioned to provide an even and regular curvature around a design feature such as an athletics track, a fountain, or other outdoor feature where water might collect.

Open water channels are known in the art for providing the removal of water that has collected on the ground and that would otherwise collect in ponds. Typically, such a channel has an open U-shape in section, allowing water to flow into the top open portion of the channel, and to be conveyed along a conduit formed by a plurality of similar channels connected together, where it may be discharged into a larger water collection system. Commonly, the open part of the channel is provided with a grating spanning between the upper tips of the U-shape, so that while water may flow into the channel, there is no danger of people stepping into the channel and injuring themselves. A plurality of similar linear channels are typically connected end-to-end to provide for a linear conduit.

Conventionally, a known method of connecting one such channel to the next is provided by a flange on one channel and a mating slot on the other. The flange is inserted into the slot to form a tight connection between the two channels. This system creates a rigid inflexible coupling that allows for the creation of an extended linear conduit made from a plurality of channels. Due to the rigidity of the coupling between each channel to the next, the resulting conduit is typically substantially straight, which is a desirable feature when the conduit is designed to extend along a feature that is straight, such as along the edge of a football field. However, there are architectural features that may require the conduit to have a radius of curvature, such as around the curved end portions of an athletics track or around a fountain feature. This requirement presents a problem for known systems of channel construction. To meet this requirement, channels are typically simply placed in an end to end abutment with each other with an axial offset angle between each to provide for an accumulated curvature for the conduit as a whole, and the segmental space between each channel is filled with a compound such as concrete or cement to prevent leakage and to secure against mobility while the conduit is being finally set in the earth. This system has the considerable disadvantage that unequal axial offset angles may be introduced into the curve, which may give an unacceptably untidy finish and appear unsightly when the overall curve is viewed from a distance. Also, the spacing between the conduits may vary, creating a generally uneven appearance that detracts from what may be an expensive feature to an overall project.

Thus there is a need in the art for a system and method of connecting open channels to each other that allows for both a rigid and straight connection where needed, and an offset connection to provide an overall curvature to a conduit where needed. The present invention addresses these and other needs.

SUMMARY OF THE INVENTION

In a preferred embodiment, a link is described for insertion between a first channel and a second channel that are configured to be connected to each other to form a linear conduit in the absence of the link. The first channel has an outwardly extending first flange on a first terminal end of the first channel, and the first flange has opposite surfaces that are parallel with each other. The second channel defines a first slot at a second terminal end of the second channel, the first slot having opposing surfaces that are parallel with each other and separated by a first width. The first flange is configured to be inserted into and mate with the first slot to form a substantially linear connection between the first and second channels. The link of the present invention, in a preferred embodiment, comprises an outwardly extending second flange on a third terminal end of the link. The second flange has opposite surfaces that are parallel with each other, and are configured to be inserted and mate with the first slot of the second channel to form a connection between the link and the second channel. The link further includes a second slot defined in a fourth terminal end of the link, the second slot having opposing surfaces configured to receive the first flange of the first channel. The opposing surfaces are spaced apart in relation to the first flange such that, when the first flange is inserted into the second slot, a substantial horizontal gap is formed between the opposite surfaces of the first flange and the opposing surfaces of the second slot that is sufficient to allow the second channel to be rotated horizontally in relation to the first channel by a substantial offset angle to the first channel that is greater than 1.5 degrees.

In another aspect of the invention, the opposing surfaces of the second slot are parallel with each other and are separated by a second width. Preferably, the second width is more than 1.5 times the first width. Further preferably, the opposing surfaces of the second slot are not parallel with each other, and the second slot has a minimum third width at a midpoint of the slot, the width of the second slot increasing in a direction moving away from the midpoint to a maximum fourth width. Desirably, the third width is substantially the same as the first width. Again desirably, the fourth width is more than 1.5 times the first width, and the fourth width is more than 1.5 times the third width. In further aspects of the invention, the shape of the second slot is symmetrical about a center line of the slot running perpendicular to a longitudinal axis of the link.

In another aspect of the invention the invention includes a channel for inclusion in a conduit comprising a plurality of similar channels that, when joined directly together, form an effectively curved conduit. The channel comprises an elongate hollow body configured to permit fluid flow, with first and second terminal ends. A slot is located at the first terminal end, the slot having opposing surfaces. An outwardly extending flange is located at the second terminal end, the flange having opposite surfaces and is configured to be inserted into a slot of an adjacent similar channel, to form a connection. The slot has opposing surfaces configured to receive a flange of an adjacent similar channel, the opposing surfaces of the slot being spaced apart in relation to a received flange such that, when the flange of an adjacent channel is inserted into the slot, a substantial horizontal gap is formed between the opposite surfaces of the flange and the opposing surfaces of the slot, the gap being sufficient to allow the channel to be rotated horizontally in relation to the adjacent similar channel by an offset angle that is greater than 1.5 degrees.

A final aspect of the invention includes a method of introducing an overall curvature into a conduit comprising first and second channels that are configured to be connected to each other to form a linear conduit, in which the first channel has an outwardly extending first flange on a first terminal end of the first channel, the first flange having opposite surfaces that are parallel with each other. The second channel defines a first slot at a second terminal end of the second channel, the first slot having opposing surfaces that are parallel with each other and separated by a first width. The first flange is configured to be inserted into and mate with the first slot to form a substantially linear connection between the first and second channels. In this context, the method of the invention comprises, cutting off an end portion of the second channel including the first slot. To second channel a replacement element is attached that includes a second slot having opposing surfaces configured to receive the first flange of the first channel, the opposing surfaces being spaced apart in relation to the first flange such that, when the first flange is inserted into the second slot, a substantial horizontal gap is formed between the opposite surfaces of the first flange and the opposing surfaces of the second slot that is sufficient to allow the second channel to be rotated horizontally in relation to the first channel by an offset angle to the first channel.

These and other advantages of the invention will become more apparent from the following detailed description thereof and the accompanying exemplary drawings.

DETAILED DESCRIPTION OF THE PREFERRED EMBODIMENTS

With reference to the drawings, which are provided by way of exemplification and not limitation, preferred embodiments having features of the present invention are described.

Figure 1:
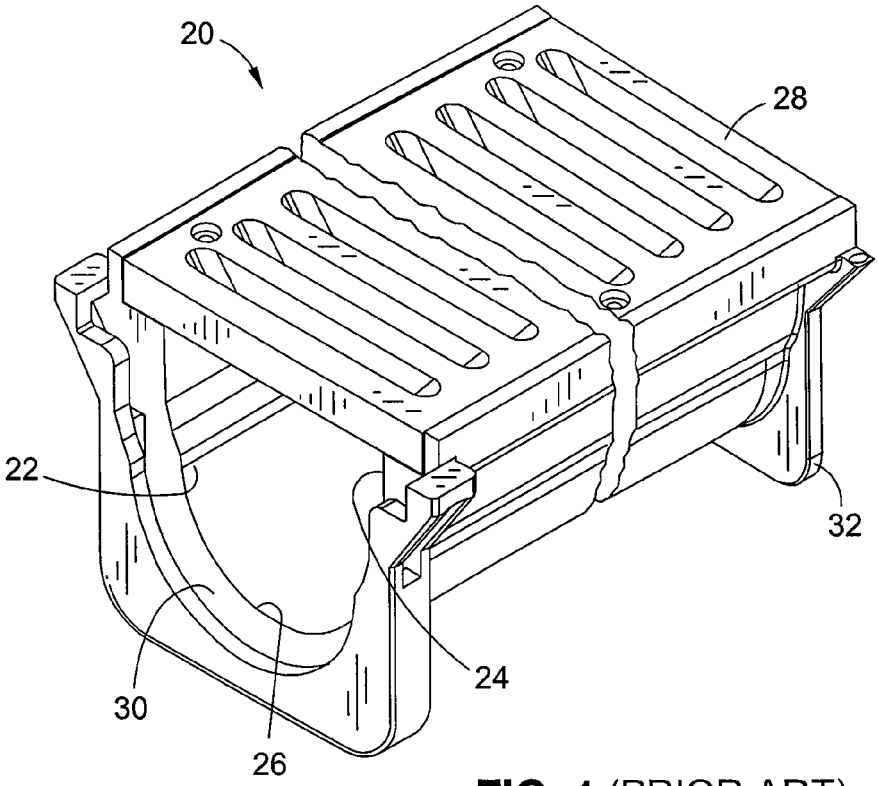
FIG. 1 (PRIOR ART)
FIG. 1 is a perspective schematic view, seen from one end, of a known water channel of a kind with which the present invention may be used in conjunction.
Figure 2:
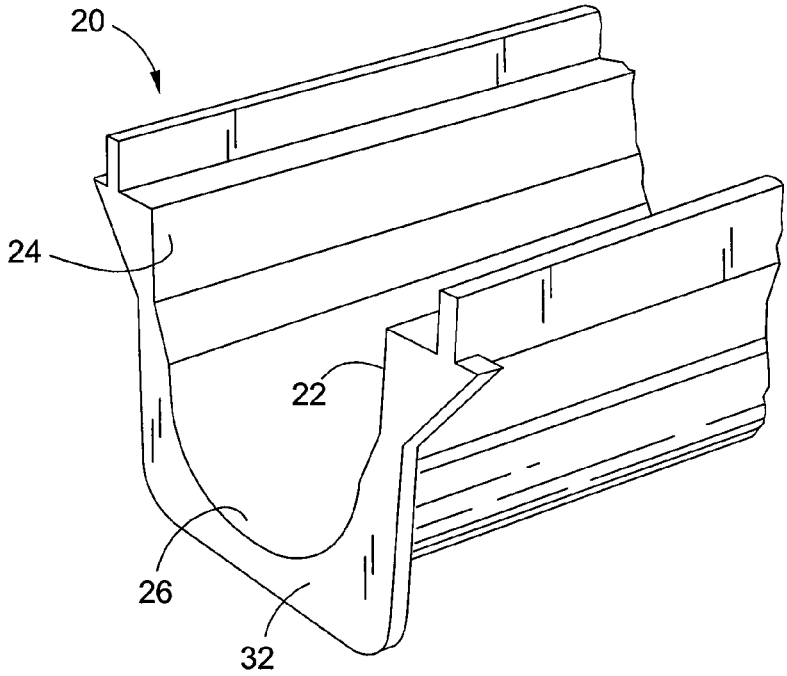
FIG. 2 (PRIOR ART)
FIG. 2 is a perspective view of a portion of the water channel of FIG. 1, seen from the other end.

By way of introduction, FIG. 1 shows a schematic representation of a typical known open U-shaped water channel 20 for embedding in the earth so as to position the upper profile of the section flush with the ground level. (Preferably, the channel shown in FIG. 1 may be about four feet long.) The channel has an elongate body comprising two vertical legs 22, 24 joined together at their bottom by a curved base 26. A grating 28 is provided to cover the open portion at the tope of the two legs of the channel. A plurality of such sections, when connected together, form a conduit for leading water away from an area where ponding might otherwise occur.

Figure 3:
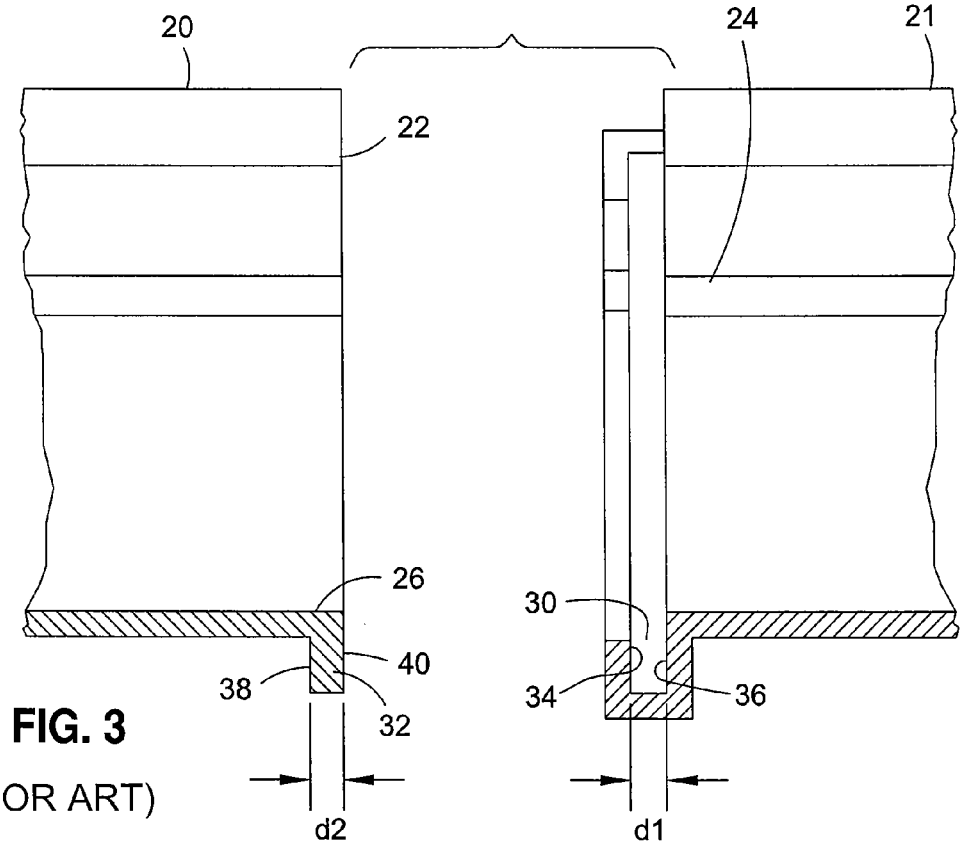
FIG. 3 (PRIOR ART)
FIG. 3 is a sectional view of two channels of the kind seen in FIG. 1, about to be connected together.
Figure 4:
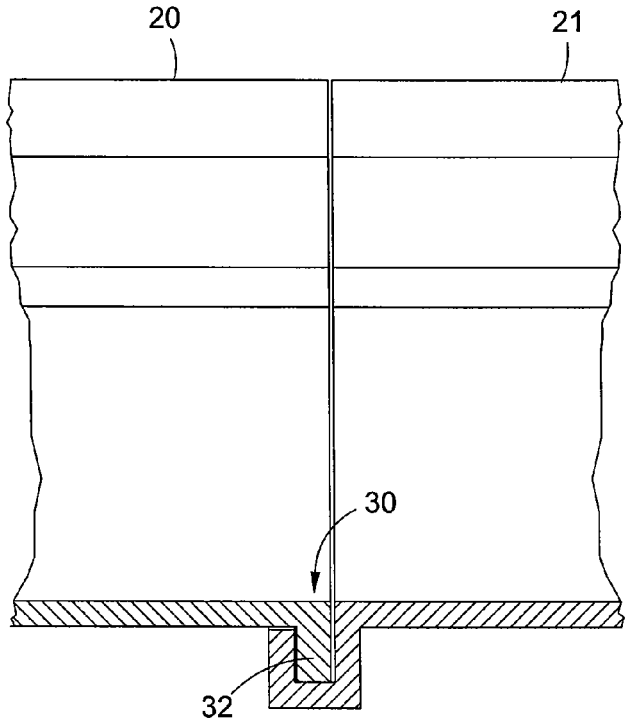
FIG. 4 (PRIOR ART)
FIG. 4 is a sectional view of two channels of the kind seen in FIG. 1, having been connected together.
Figure 5:
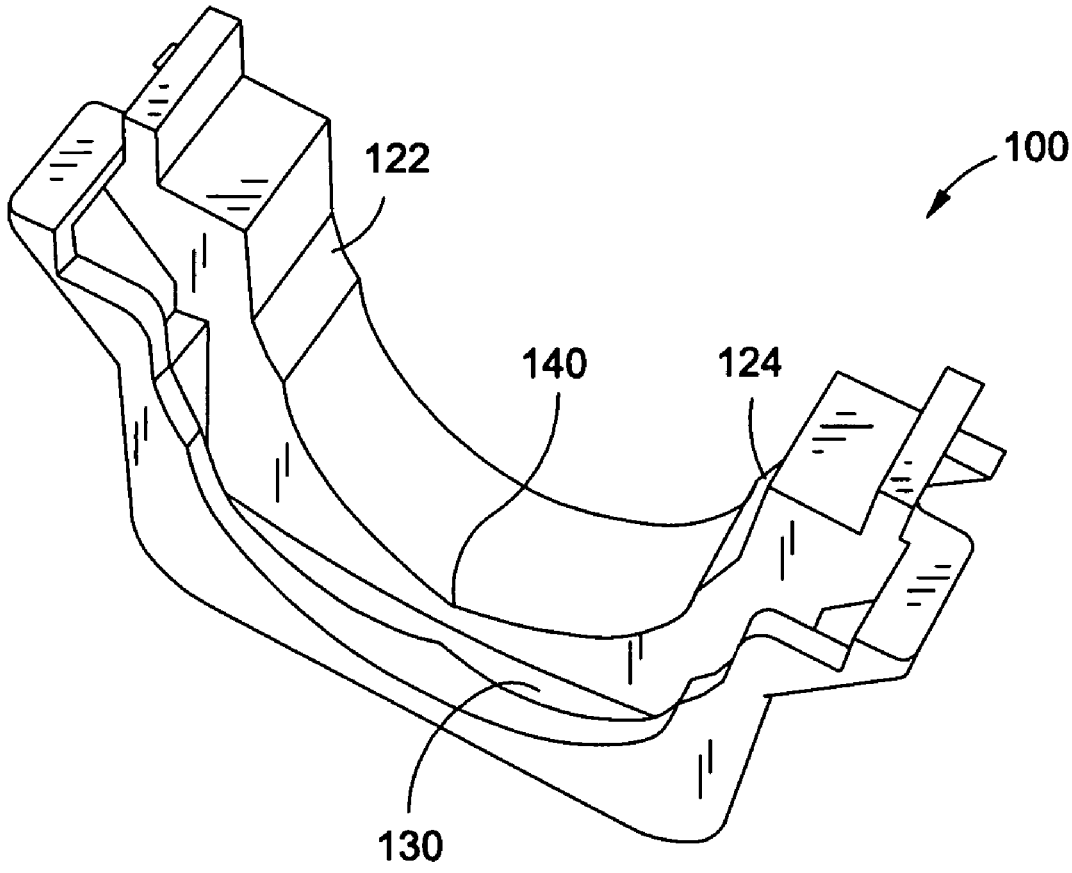
FIG. 5. is a perspective view of a first embodiment of a link element having features of the present invention.

With reference to FIGS. 1-4, a known structure is described for connecting two such sections together, end to end. This structure comprises, on one end of the channel 20, a slot 30 that extends substantially around the U shape of the channel. On the opposite end of the channel, a flange 32 extends substantially around the exterior of the U shape of the channel. The flange 32 is seen in FIG. 1 on the right end of the channel, and in FIG. 2, on the left end of a similar channel viewed from the opposite end. The flange 32 of one channel is shaped to tightly fit into the slot 30 of the next channel. As seen in FIGS. 3-4, the two channels 20, 21 are connected together by inserting the flange 32 of one channel into the slot 30 of the next channel and pressing the two channels into alignment. Notably, the slot 30 has opposing faces 34, 36 that are parallel to each other and are set a certain distance d1 apart. The flange 32 also has opposite faces 38, 40 parallel to each other and set apart a distance d2 that is slightly less than d1, the distance between the opposing faces of the slot, to allow for manufacturing intolerances which might otherwise in an extreme case prevent a flange 32 from inserting into a slot 30. These parallel faces of slot and flange, with substantially similar dimensions between them, facilitate a tight fitting and abutting connection between adjacent channels 20, 21 (FIGS. 3-4).

In this abutting relationship, the two channels are rigidly connected together, and a considerable amount of strength can be developed by this connection so that artisans can connect a plurality of channels together, then lift the resulting conduit and place it in position in a furrow in the earth where surrounding earth may be heaped around it and compacted to form a secure bedding for the conduit. This system of connection is advantageous in, and has been developed for, those circumstances where a substantially straight conduit is desired, such as along the edge of a football field, a tennis court, or pathway that extends in a straight line. The conduit produced by this method of connection extends in a substantially straight line, and the aesthetics of the situation are satisfied. As used herein, the term "substantially" is intended to recognize that manufacturing intolerances may create a geometrical shape that does not meet its exact description, but nonetheless satisfies the description when manufacturing tolerances have been taken into account.

However, a shortcoming in this known art arises in that, when a regular curved conduit is desired, the connection described above is not capable of producing a suitable curve, regular or otherwise. The flange and slot arrangement as described does not allow a curve to be formed but compels the channels to assume a substantially straight line conduit.

Accordingly, the present novel system provides an inexpensive and easy to manufacture structure that allows channels of the kind described to form an evenly curving conduit suitable for uses in situations such as those described. The present invention may be deployed in a number of different embodiments.

In a first embodiment, the invention allows channels that have already been manufactured with the jointing system described and shown in FIGS. 1-4 above, to be fitted with an insertable linking system capable of introducing a curve into the conduit that may be created when the channels are joined together. To achieve this first embodiment of the invention, a novel insert link, as described with reference to FIGS. 5-14, is provided.

Figure 6:
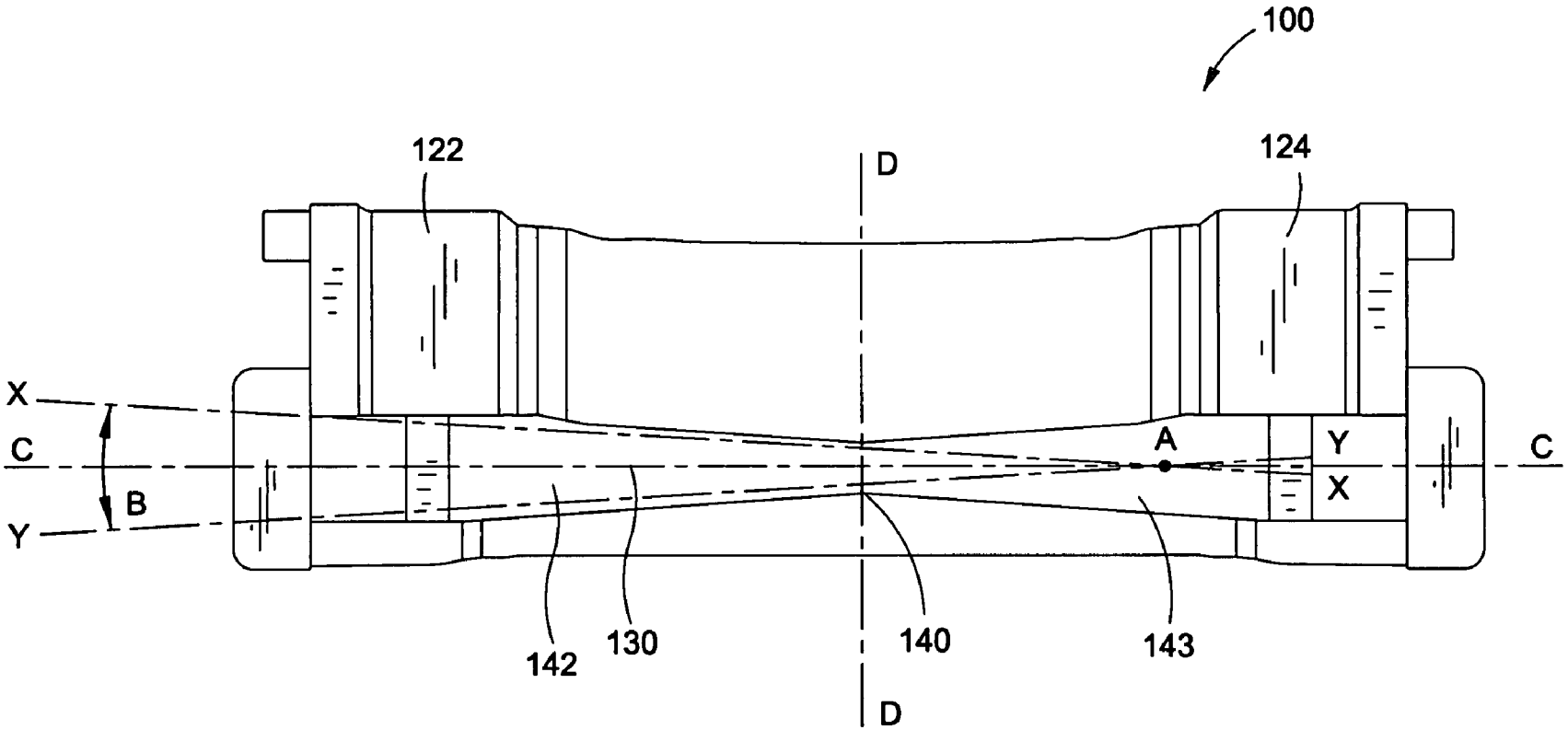
FIG. 6 is a top view of the link element of FIG. 5.
Figure 7:
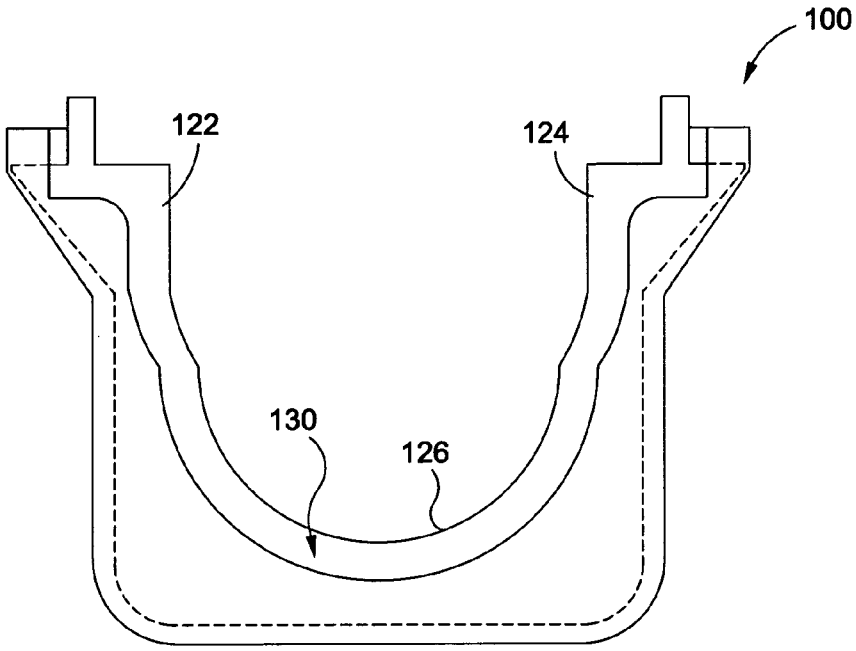
FIG. 7 is a front elevational view of the link element of FIG. 5.
Figure 8:
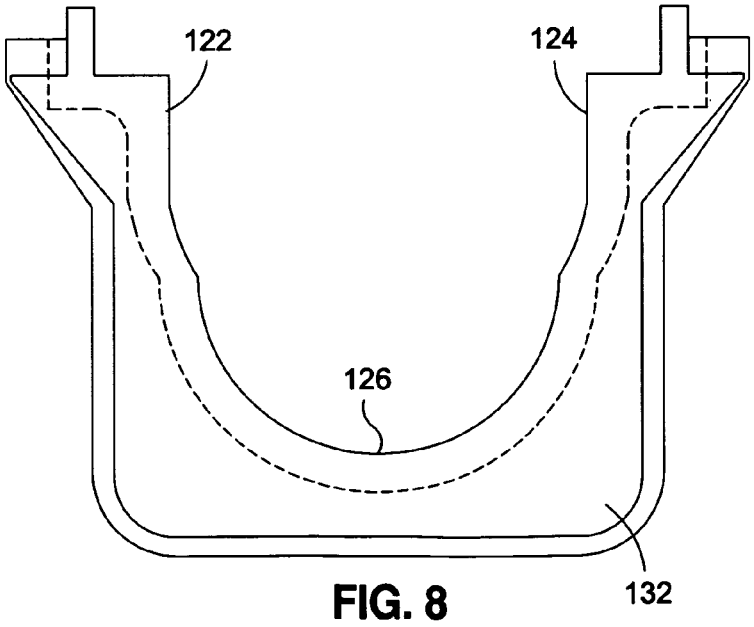
FIG. 8 is a rear elevational view of the link element of FIG. 5.
Figure 9:
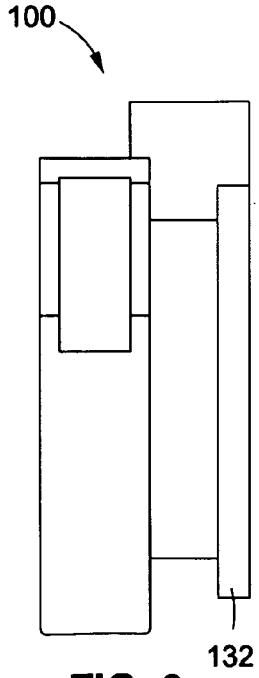
FIG. 9 is a side elevational view of the link element of FIG. 5.

In a first embodiment described with reference to FIGS. 5-12, an insert link 100 has some of the characteristics of a very short channel of the kind described above and seen in FIG. 1. The link 100 is preferably only between two and six inches long, but highly desirably between 1.0 inches and 2.5 inches long. Where the length of the channel is 4 feet long, 6 inches for the link translates to 13% of the length of the channel, and the preferred embodiment includes a link of less than 13% of the length of the channel in the general case, and most desirably, less than 6%. The link 100 includes a U-shape similar to that of the channel 20 for which it is designed to cooperate, and is sized to match at least the inner profile of the channel 20 in order to reduce flow turbulence. The link has legs 122, 124 (that spatially correspond with legs 22 and 24 of the channel 20) joined together at their bottom by a curved base portion 126 (spatially corresponding with base portion 26 of the channel 20). The link 100 has a flange 132 at one axially terminal end of the link, the axis being taken along the line D-D as indicated in FIG. 6. The flange 132 of the link has the same dimensions as the flange 32 of the channel 20, and is configured to fit into and engage with the slot 32 of an adjacent channel. The link 100 has a slot 130 at the terminal end of the link opposite the flange 132, but the slot 130 of the link is shaped to have significant differences than the slot 30 of the channel 20.

Figure 10:
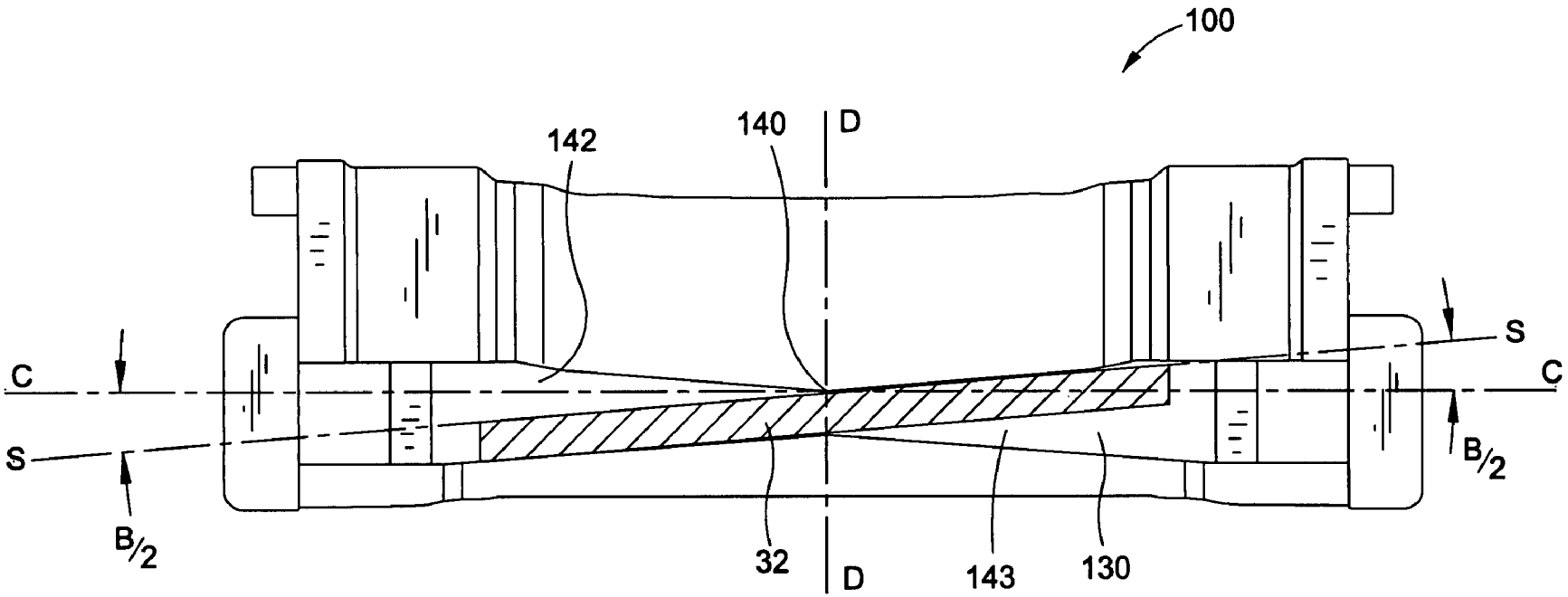
FIG. 10 is the same view as FIG. 6, shown in relation to an inserted flange.

Preferably, as seen in FIGS. 6 and 10, a center point 140 of the slot 130 has a width that is substantially the same as the width of the slot 30 in the channel 20. However, the width of the slot 130 gradually increases in both directions moving away from the center point 140, to provide a slot with two wedge shaped portions 142, 143 extending away from the center point 140. In a preferred embodiment, lines X-X and Y-Y that are drawn along the two sides of a wedge portion intersect at a point A, and preferably include an angle of B degrees. Preferably, the maximum width of the slot 130 at the ends is more than 1.5 times the width of the slot at the center point 140 (and also, the width of the flange 32 of the channel 20). Desirably, the angle B is bisected by an axis C-C that is perpendicular to the longitudinal axis D-D of the link. Thus, while the width between the sides of the slot 130 may be about ⅜ inch apart at the center point, the width may be about ⅝ inch apart at the ends of the wedge adjacent the legs 122, 124. In this configuration, the flange 32 of a channel may be inserted in the slot 130 of the link 100 and the channel 20 may be twisted horizontally either clockwise or anticlockwise, as seen in FIG. 10, so that the channel 20 (not seen in FIG. 10) may be axially offset in relation to the link 100 by an amount equal to half the angle B. It will be understood that the angle B will vary depending on the maximum width of the slot 130.

Figure 13:
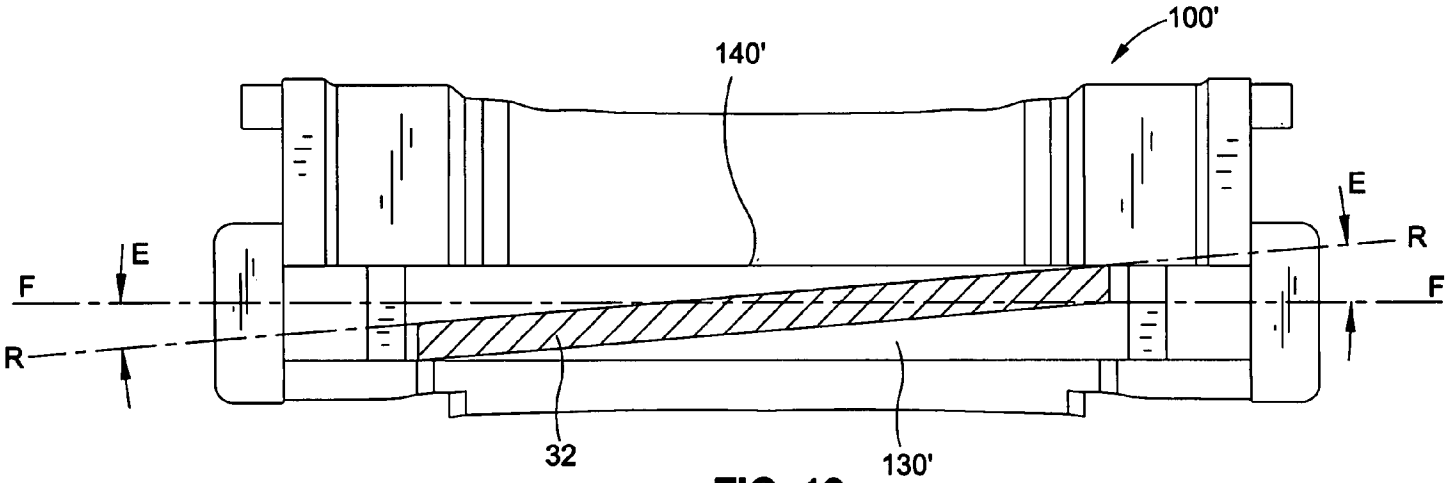
FIG. 13 is top view of a second embodiment of the link element having features of the present invention.
Figure 14:
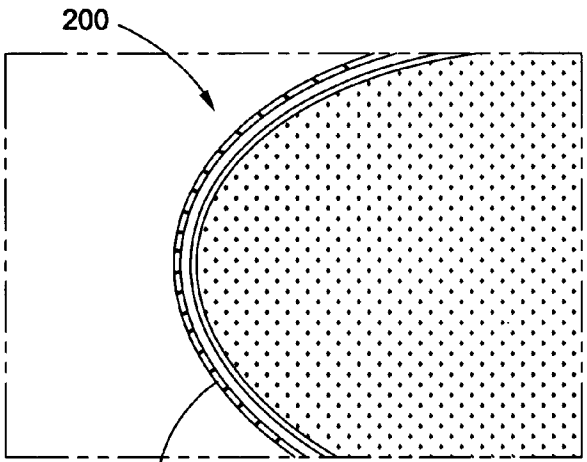
FIG. 14 is a perspective view of a plurality of channels connected together by the link element of the present invention.

In an alternative embodiment, exemplified in FIG. 13, a link 100' is described that has similar advantages to those of the link 100. A differently shaped slot 130' is provided in the link 100', wherein the slot 130' does not gradually widen in a direction away from the center point 140' of the slot, but has the same broad width throughout its length. In this case, the width of the slot 130' is preferably more than 1.5 times the width of the flange 32 over the entire length of the slot 130'. In this embodiment, as in the previous embodiment, the flange 32 of an adjacent channel may be inserted in the slot 130' and twisted horizontally, either clockwise or anticlockwise, so that the adjacent channel is axially offset by an angle E in relation to the link 100', as shown in FIG. 13. It will be understood that the angle E will vary depending on the relative widths of the slot 130' and the flange 32.

In channels 20 of the kind described above that are presently constructed, there is a small difference between the width of a regular slot 30 and the width of a regular channel 32, designed and introduced to allow for possible manufacturing intolerances. Therefore, a small axial offset angle of one channel in relation to the next one may emerge as a result of this design. However, these small offset angles are insubstantial, and are designed to be kept to a minimum compatible with manufacturing processes and intolerances. The axial offset angles contemplated by the present invention are not insubstantial, and are designed to create a substantial offset angle, in the range greater than 1.5 degrees preferably greater than 2 degrees, and highly preferably greater than 2.5 degrees. An example of the size of offset angle that may emerge as a result of a design to accommodate manufacturing intolerances is in the region of one half of a degree.

In yet further alternative embodiments (not shown), the link may be constructed to provide a flange that has wedge shaped portions extending away from a center point of the flange, with the wedges pointing outward from the flange. Such a flange, when inserted into a regular slot 30 with parallel opposing surfaces, would be permitted a certain amount of rotation within the slot, to produce an axial offset between two channels attached to either end of the link. Furthermore, the same result may be achieved by providing a link with a flange that has opposite walls parallel to each other, but which has a much reduced thickness, although these embodiments would suffer from the disadvantage that reducing material from a regular shaped flange for the link would tend to reduce the strength of the link.

Figure 11:
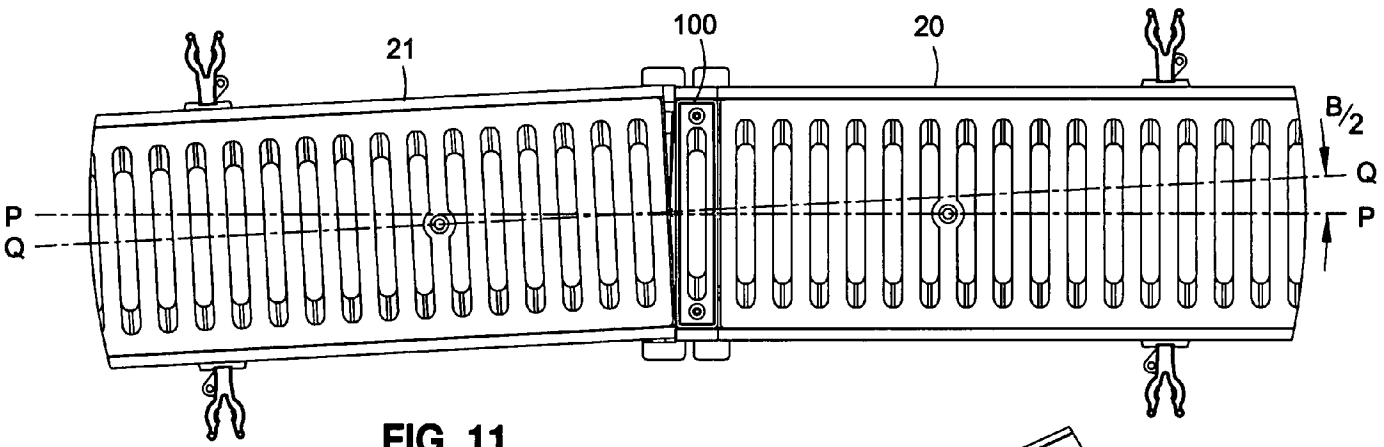
FIG. 11 is a top view of a link element of the present invention linking two channels together.
Figure 12:
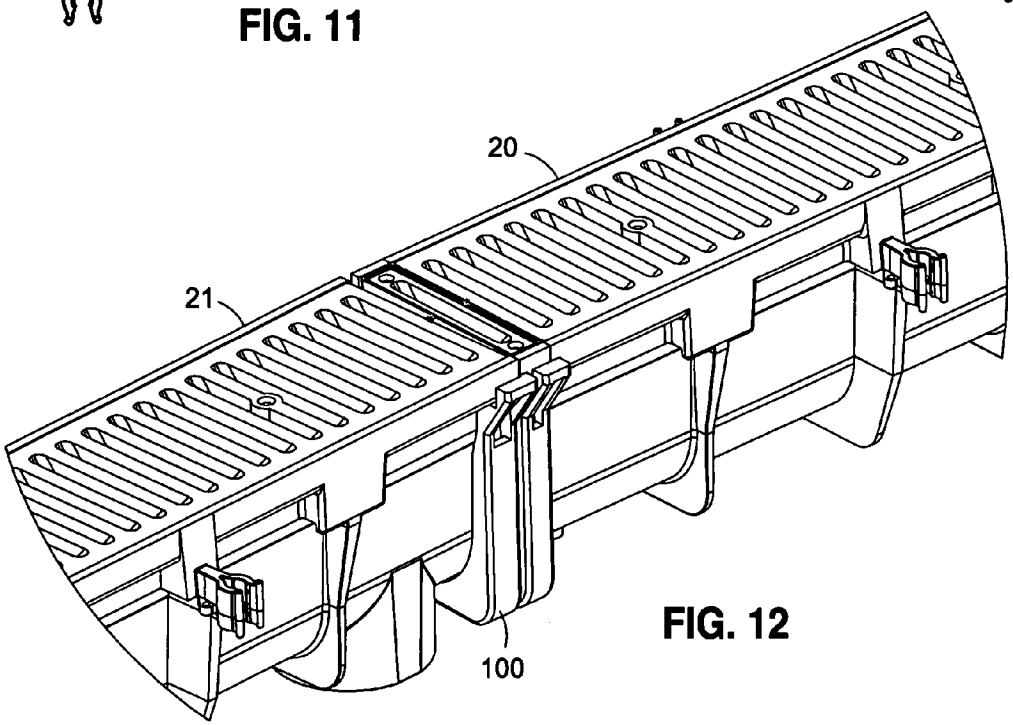
FIG. 12 is a perspective side view of the link element and channels of FIG. 11.

In use, the link of the present invention is applied as follows. Instead of joining a first channel 20 directly to a second adjacent channel 21 as exemplified in FIGS. 2-3, a first channel is joined to an insert link 100 by inserting the flange 132 of the link into the slot 30 of the channel. The first channel 20 and the link 100 are thus securely and rigidly joined together so as to expose the slot 130 of the link 100. The flange 32 of the second channel 21 is then inserted in the exposed slot 130 of the link, and the second channel is twisted horizontally to the limit of travel permitted to the flange 32 in the slot 130, as exemplified in FIG. 10, to create and offset angle of B/2 as is seen between axis C-C and a plane of the flange S-S. The result, exemplified in FIGS. 11-12, is that a first channel 20 is aligned with a second channel 21 vertically, but the axis P-P of the second channel 21 is horizontally off axial alignment with the axis Q-Q of the first channel 20 by a maximum angle of B/2, or one half of the angle between the wedged sides of the slot 130. (When the embodiment 100' is used, the angle E as seen in FIG. 13 is the offset angle).

A departure from straight axial alignment of about 2.2 degrees (resulting from a subtended angle of the sides of a wedge 142 of about 4.4 degrees) between two channels that are 4 feet long, when repeated a number of times between successive channels, will produce a curved conduit with an effective radius of about 100 feet. This is a typical radius of an end portion of a standard athletics track. Thus it will be seen that insertion of a link 100 permitting a 2.2 degree offset as described between each of a series of 4 foot channels will allow the channels to be axially offset in relation to each other to produce a conduit 200 in a gradual curve that ideally fits an athletics track, such as exemplified in FIG. 14. Where other features require a different curvature, the angle B subtended by the sides of the wedge (or the angle E as seen in FIG. 13) may be increased or decreased to suit the requirement by changing the maximum widths of the slot 130, and 130'. An advantage enjoyed by wedge shaped slot 130 of the first embodiment over a parallel slot 130' of the second embodiment, is that a flange 32 inserted into the wedge shaped slot 130 is loaded by the surfaces of the wedge substantially evenly over the whole length of the flange, the load changing direction after the center point 140. This continuous loading creates a smaller bending moment on the flange than in the second embodiment, where the loading is applied as two point loads at the very tips of the flange.

Thus it will be seen that the insert links 100 and 100' of the present invention may be applied to channels that have been manufactured to provide a straight conduit, and the same channels may yet be used to provide a curved conduit. This has considerable advantage because, where a manufacturer has already tooled up to make channels for a straight conduit, it is not necessary to change the tooling to manufacture a different channel suitable for a curved conduit. The tooling to manufacture the small insert link is less expensive than that for a channel, and so the manufacture of insert links 100 for use in conjunction with channels 20 is economical and effective. In another aspect, where a smaller radius is required, two links 100 may be used in conjunction with each other, thereby doubling the offset angle for which any single link has been manufactured. This is an efficient and inexpensive way of obtaining a number of different offset angles from a single tooling used to manufacture one kind of link. In yet another aspect, where a larger radius of curvature is required, one link may be inserted every second channel, or even third channel, to create a conduit with very gentle curvature. Thus it will be seen that, when used in conjunction with a standard form of channel designed for straight conduits, the link of the present invention allows multiple curvatures to be introduced into the end product.

However, the principle of the described embodiment may be extended to other applications. In another embodiment of the invention, a channel may be manufactured to include a slot that has the geometry of the slot 130 (or 130') of an insert link, either in the first embodiment of link 100 or the second embodiment of link 100'. It will be appreciated that a series of such channels will be capable of providing a curved conduit without the use of insert links 100 between them. This will of course require new tooling to manufacture such a channel. It will also be appreciated that such a channel will not be suitable for providing straight conduits because the broader width of the new slot will allow one channel to assume an alignment in relation to an adjacent channel that is slightly off axial alignment and not straight. This will tend to have the undesired result that a long conduit that is intended to be straight, will tend to include an axial "wobble" along its length, in which non-linear joints are achieved that give the resulting conduit an unattractive and non-straight appearance. Of course, this can be overcome by using one set of channels with a regular slot 30 (with sides spaced to mate with flange 32) in situations where a straight conduit is desired, and another set of channels with wedge shaped slots 130 (or parallel broad slots 130') where a curved conduit is desired. This solution imposes on a manufacturer the requirement of stocking two types of channel, one for straight and one for curved conduits. Where such is deemed too complicated, an insert wedge 100 may be provided as an inexpensive solution to this complexity.

In yet another application of the principles of the present invention, the attributes of the invention may be imparted to channels that have already been manufactured for inclusion in a linear conduit. This is accomplished by commencing with such a regular channel, and cutting off the end portion that includes the slot 30. A link 100 (or 100') is then taken and cut vertically to separate the flange portion 132 from the slot portion 130 (or 130'). Then, the slot portion 130 (or 130') is fixed to the end of the channel which has had its slot 30 removed. Such fixation may be achieved by heat fusion, or by adhesive. In this manner, a conventional channel that has been designed and constructed for a straight conduit may inexpensively be converted into a channel suitable for a curved conduit.

Thus, it is seen that the solution of the present invention provides novel and useful features for overcoming shortcomings in the prior art. The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

We claim:

1. A link, for insertion between a first channel and a second channel that are configured to be connected to each other to form a linear conduit in the absence of the link, the first channel having an outwardly extending first flange on a first terminal end of the first channel, the first flange having opposite surfaces that are parallel with each other, the second channel defining a first slot at a second terminal end of the second channel, the first slot having opposing surfaces that are parallel with each other and separated by a first width, the first flange being configured to be inserted into and mate with the first slot to form a substantially linear connection between the first and second channels, the link comprising:

an outwardly extending second flange on a third terminal end of the link, the second flange having opposite surfaces that are parallel with each other, and being configured to be inserted and mate with the first slot of the second channel to form a connection between the link and the second channel; and a second slot defined in a fourth terminal end of the link, the second slot having opposing surfaces configured to receive the first flange of the first channel, the opposing surfaces being spaced apart in relation to the first flange such that, when the first flange is inserted into the second slot, a horizontal gap is formed between the opposite surfaces of the first flange and the opposing surfaces of the second slot that is sufficient to allow the second channel to be rotated horizontally in relation to the first channel by an offset angle to the first channel that is greater than 1.5 degrees.

2. The link of claim 1, wherein the opposing surfaces of the second slot are parallel with each other and are separated by a second width.

3. The link of claim 2, wherein the second width is more than 1.5 times the first width.

4. The link of clam 1, wherein the opposing surfaces of the second slot are not parallel with each other, and wherein the second slot has a minimum third width at a midpoint of the slot, the width of the second slot increasing in a direction moving away from the midpoint to a maximum fourth width.

5. The link of claim 4, wherein the third width is substantially the same as the first width.

6. The link of claim 4, wherein the fourth width is more than 1.5 times the first width.

7. The link of claim 4, wherein the fourth width is more than 1.5 times the third width.

8. The link of claim 4, wherein the shape of the second slot is symmetrical about a center line of the slot running perpendicular to a longitudinal axis of the link.

9. The link of claim 1, wherein the offset angle is greater than two degrees.

10. The link of claim 1, wherein the length of the link in the direction of a longitudinal axis of the link is between 1.0 and 2.5 inches.

11. The link of claim 1, wherein the first channel has a first length, and the link has a second length, the second length being less than 13% of the first length.

12. The link of claim 1, wherein the first channel has a first length, and the link has a second length, the second length being less than 6% of the first length.

13. A channel for inclusion in a conduit comprising a plurality of similar channels that, when joined directly together, form an effectively curved conduit, the channel comprising:

an elongate hollow body configured to permit fluid flow, with first and second terminal ends;

a slot at the first terminal end, the slot having opposing surfaces;

an outwardly extending flange at the second terminal end, the flange having opposite surfaces and being configured to be inserted into a slot of an adjacent similar channel, to form a connection; and the slot having opposing surfaces configured to receive a flange of an adjacent similar channel, the opposing surfaces of the slot being spaced apart in relation to a received flange such that, when the flange of an adjacent channel is inserted into the slot, a horizontal gap is formed between the opposite surfaces of the flange and the opposing surfaces of the slot, the gap being sufficient to allow the channel to be rotated horizontally in relation to the adjacent similar channel by an offset angle that is greater than 1.5 degrees;

wherein the opposing surfaces of the slot are not parallel with each other, and wherein the slot has a minimum width at a midpoint of the slot, the width of the slot increasing in a direction moving away from the midpoint to a maximum width.

14. The link of claim 13, wherein the shape of the slot is symmetrical about a center line of the slot running perpendicular to a longitudinal axis of the channel.

15. The link of claim 13, wherein the offset angle is greater than two degrees.

16. A method of introducing an overall curvature into a conduit comprising first and second channels that are configured to be connected to each other to form a linear conduit, the first channel having an outwardly extending first flange on a first terminal end of the first channel, the first flange having opposite surfaces that are parallel with each other, the second channel defining a first slot at a second terminal end of the second channel, the first slot having opposing surfaces that are parallel with each other and separated by a first width, the first flange being configured to be inserted into and mate with the first slot to form a substantially linear connection between the first and second channels, the method comprising:

cutting off an end portion of the second channel including the first slot;

attaching to the second channel a replacement element including a second slot having opposing surfaces configured to receive the first flange of the first channel, the opposing surfaces being spaced apart in relation to the first flange such that, when the first flange is inserted into the second slot, a horizontal gap is formed between the opposite surfaces of the first flange and the opposing surfaces of the second slot that is sufficient to allow the second channel to be rotated horizontally in relation to the first channel by an offset angle to the first channel.

17. The method of claim 16, wherein the opposing surfaces of the second slot are parallel with each other.

18. The link of clam 16, wherein the opposing surfaces of the second slot are not parallel with each other, and wherein the slot has a minimum width at a midpoint of the slot, the width of the slot increasing in a direction moving away from the midpoint to a maximum width, the maximum width being more than 1.5 times the minimum width.

19. The link of claim 16, wherein the shape of the second slot is symmetrical about a center line of the slot running perpendicular to a longitudinal axis of the channel.

20. The link of claim 16 wherein the offset angle is greater than 1.5 degrees.

21. The link of claim 20 wherein the offset angle is greater than two degrees.

* * * * *